US008385764B2

(12) United States Patent
Takahashi

(10) Patent No.: US 8,385,764 B2
(45) Date of Patent: Feb. 26, 2013

(54) IMAGE FORMING APPARATUS

(75) Inventor: Katsumi Takahashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/480,401

(22) Filed: Jun. 8, 2009

(65) Prior Publication Data

US 2009/0304405 A1 Dec. 10, 2009

(30) Foreign Application Priority Data

Jun. 9, 2008 (JP) ..... 2008-150487

(51) Int. Cl.
*G03G 15/20* (2006.01)

(52) U.S. Cl. ..... 399/69

(58) Field of Classification Search ..... 439/913; 399/69

See application file for complete search history.

(56) References Cited

U.S. PATENT DOCUMENTS 5,971,935 A * 10/1999 Higgins et al. ..... 600/526
6,420,854 B1 * 7/2002 Hughes et al. ..... 320/165

FOREIGN PATENT DOCUMENTS

JP 04190382 A * 7/1992
JP 08-35860 2/1996
JP 08-50941 2/1996

* cited by examiner

*Primary Examiner* — Constantine Hannaher
(74) *Attorney, Agent, or Firm* — Canon U.S.A., Inc. IP Division

(57) ABSTRACT

An image forming apparatus includes an image forming unit, a fixing unit, a temperature sensor including an element in which a resistance value increases as a temperature decreases and configured to detect a temperature of the fixing unit, a connector configured to transmit an output signal of the temperature sensor, a control unit disposed on a side opposed to the temperature sensor with respect to the connector and configured to control the temperature of the fixing unit based on the output signal of the temperature sensor, a resistor disposed on the same side of the temperature sensor with respect to the connector and connected to the temperature sensor in parallel, and a power source disposed on the side opposed to the temperature sensor with respect to the connector and configured to supply currents to the temperature sensor and the resistor via the connector.

3 Claims, 16 Drawing Sheets

FIG.5

| DETECTED TEMPERATURE | THERMISTOR RESISTANCE VALUE |
|---|---|
| 0[°C] | 98.540[kΩ] |
| 10[°C] | 64.999[kΩ] |
| 20[°C] | 43.907[kΩ] |
| 30[°C] | 30.319[kΩ] |
| 40[°C] | 21.365[kΩ] |
| 50[°C] | 15.342[kΩ] |
| 60[°C] | 11.210[kΩ] |
| 70[°C] | 8.325[kΩ] |
| 80[°C] | 6.276[kΩ] |
| 90[°C] | 4.797[kΩ] |
| 100[°C] | 3.715[kΩ] |
| 110[°C] | 2.912[kΩ] |
| 120[°C] | 2.309[kΩ] |
| 130[°C] | 1.850[kΩ] |
| 140[°C] | 1.497[kΩ] |
| 150[°C] | 1.223[kΩ] |
| 160[°C] | 1.007[kΩ] |
| 170[°C] | 0.836[kΩ] |
| 180[°C] | 0.700[kΩ] |
| 190[°C] | 0.590[kΩ] |
| 200[°C] | 0.501[kΩ] |
| 210[°C] | 0.428[kΩ] |
| 220[°C] | 0.368[kΩ] |
| 230[°C] | 0.318[kΩ] |
| 240[°C] | 0.276[kΩ] |
| 250[°C] | 0.241[kΩ] |

FIG.6

| DETECTED TEMPERATURE | DETECTED VOLTAGE | AD VALUE (8bit) |
|---|---|---|
| 0[°C] | 3.234[V] | 250 |
| 10[°C] | 3.201[V] | 247 |
| 20[°C] | 3.156[V] | 244 |
| 30[°C] | 3.096[V] | 239 |
| 40[°C] | 3.018[V] | 233 |
| 50[°C] | 2.919[V] | 226 |
| 60[°C] | 2.800[V] | 216 |
| 70[°C] | 2.661[V] | 206 |
| 80[°C] | 2.502[V] | 193 |
| 90[°C] | 2.329[V] | 180 |
| 100[°C] | 2.145[V] | 166 |
| 110[°C] | 1.956[V] | 151 |
| 120[°C] | 1.768[V] | 137 |
| 130[°C] | 1.586[V] | 123 |
| 140[°C] | 1.413[V] | 109 |
| 150[°C] | 1.252[V] | 97 |
| 160[°C] | 1.105[V] | 85 |
| 170[°C] | 0.973[V] | 75 |
| 180[°C] | 0.856[V] | 66 |
| 190[°C] | 0.752[V] | 58 |
| 200[°C] | 0.661[V] | 51 |
| 210[°C] | 0.581[V] | 45 |
| 220[°C] | 0.512[V] | 40 |
| 230[°C] | 0.452[V] | 35 |
| 240[°C] | 0.400[V] | 31 |
| 250[°C] | 0.355[V] | 27 |

FIG.8

| DETECTED TEMPERATURE | THERMISTOR RESISTANCE VALUE | COMBINED RESISTANCE VALUE | CURRENT VALUE [mA] |
|---|---|---|---|
| 0[°C] | 98.540[kΩ] | 2.343[kΩ] | 1.054[mV] |
| 10[°C] | 64.999[kΩ] | 2.315[kΩ] | 1.061[mV] |
| 20[°C] | 43.907[kΩ] | 2.276[kΩ] | 1.069[mV] |
| 30[°C] | 30.319[kΩ] | 2.224[kΩ] | 1.081[mV] |
| 40[°C] | 21.365[kΩ] | 2.158[kΩ] | 1.097[mV] |
| 50[°C] | 15.342[kΩ] | 2.075[kΩ] | 1.117[mV] |
| 60[°C] | 11.210[kΩ] | 1.977[kΩ] | 1.142[mV] |
| 70[°C] | 8.325[kΩ] | 1.863[kΩ] | 1.173[mV] |
| 80[°C] | 6.276[kΩ] | 1.736[kΩ] | 1.209[mV] |
| 90[°C] | 4.797[kΩ] | 1.600[kΩ] | 1.250[mV] |
| 100[°C] | 3.715[kΩ] | 1.458[kΩ] | 1.296[mV] |
| 110[°C] | 2.912[kΩ] | 1.316[kΩ] | 1.346[mV] |
| 120[°C] | 2.309[kΩ] | 1.177[kΩ] | 1.398[mV] |
| 130[°C] | 1.850[kΩ] | 1.045[kΩ] | 1.452[mV] |
| 140[°C] | 1.497[kΩ] | 0.922[kΩ] | 1.505[mV] |
| 150[°C] | 1.223[kΩ] | 0.810[kΩ] | 1.558[mV] |
| 160[°C] | 1.007[kΩ] | 0.709[kΩ] | 1.608[mV] |
| 170[°C] | 0.836[kΩ] | 0.620[kΩ] | 1.655[mV] |
| 180[°C] | 0.700[kΩ] | 0.542[kΩ] | 1.700[mV] |
| 190[°C] | 0.590[kΩ] | 0.474[kΩ] | 1.740[mV] |
| 200[°C] | 0.501[kΩ] | 0.414[kΩ] | 1.777[mV] |
| 210[°C] | 0.428[kΩ] | 0.363[kΩ] | 1.810[mV] |
| 220[°C] | 0.368[kΩ] | 0.319[kΩ] | 1.839[mV] |
| 230[°C] | 0.318[kΩ] | 0.281[kΩ] | 1.865[mV] |
| 240[°C] | 0.276[kΩ] | 0.248[kΩ] | 1.889[mV] |
| 250[°C] | 0.241[kΩ] | 0.219[kΩ] | 1.909[mV] |

FIG.9

| DETECTED TEMPERATURE | COMBINED RESISTANCE VALUE | DETECTED VOLTAGE | AD VALUE (8bit) |
|---|---|---|---|
| 0[°C] | 2.343[kΩ] | 2.470[V] | 191 |
| 10[°C] | 2.315[kΩ] | 2.455[V] | 190 |
| 20[°C] | 2.276[kΩ] | 2.433[V] | 188 |
| 30[°C] | 2.224[kΩ] | 2.405[V] | 186 |
| 40[°C] | 2.158[kΩ] | 2.367[V] | 183 |
| 50[°C] | 2.075[kΩ] | 2.319[V] | 179 |
| 60[°C] | 1.977[kΩ] | 2.258[V] | 175 |
| 70[°C] | 1.863[kΩ] | 2.185[V] | 169 |
| 80[°C] | 1.736[kΩ] | 2.099[V] | 162 |
| 90[°C] | 1.600[kΩ] | 2.000[V] | 155 |
| 100[°C] | 1.458[kΩ] | 1.890[V] | 146 |
| 110[°C] | 1.316[kΩ] | 1.770[V] | 137 |
| 120[°C] | 1.177[kΩ] | 1.645[V] | 127 |
| 130[°C] | 1.045[kΩ] | 1.516[V] | 117 |
| 140[°C] | 0.922[kΩ] | 1.388[V] | 107 |
| 150[°C] | 0.810[kΩ] | 1.262[V] | 97 |
| 160[°C] | 0.709[kΩ] | 1.141[V] | 88 |
| 170[°C] | 0.620[kΩ] | 1.027[V] | 79 |
| 180[°C] | 0.542[kΩ] | 0.921[V] | 71 |
| 190[°C] | 0.474[kΩ] | 0.824[V] | 64 |
| 200[°C] | 0.414[kΩ] | 0.736[V] | 57 |
| 210[°C] | 0.363[kΩ] | 0.657[V] | 51 |
| 220[°C] | 0.319[kΩ] | 0.586[V] | 45 |
| 230[°C] | 0.281[kΩ] | 0.523[V] | 40 |
| 240[°C] | 0.248[kΩ] | 0.467[V] | 36 |
| 250[°C] | 0.219[kΩ] | 0.418[V] | 32 |

IMAGE FORMING APPARATUS

BACKGROUND OF THE INVENTION

1. Field of the Invention

The present invention relates to a control apparatus capable of improving a conductive state in a signal line and a signal line connection unit in an image forming apparatus such as a copying machine or a printer which uses an electrophotographic process.

2. Description of the Related Art

A thermistor is frequently used in detecting a temperature of a fixing device of the image forming apparatus. To detect the temperature of the fixing device, the thermistor is installed within the fixing device, and configured to transmit a detected signal to a control unit such as a central processing unit (CPU) via a signal line and a connector.

The control unit controls the fixing device to maintain a predetermined temperature based on the detected signal from the thermistor.

The thermistor applied to the fixing device is configured to have high detection accuracy in a high temperature, since the thermistor is installed in order to detect a temperature in heating and fixing toner on a transfer material, in other words, a temperature in a high-temperature area. A resistance value of the thermistor is usually about several hundreds to several kilo Ω. Further, the detection accuracy in a low-temperature area such as a room temperature is low, and a resistance value in the low-temperature area is usually several hundreds to several mega Ω.

Due to such characteristics, when a temperature of the fixing device is low, only a small amount of current (μA order) flows in the signal line and the connector to which the thermistor is connected because of a high resistance value of the thermistor. In such a case, the following problem occurs.

Since only a small amount of current flows in the signal line to which the connector is connected, when external noises enter the signal line, a detected signal of the thermistor on the signal line is easily disturbed. When the detected signal of the thermistor is disturbed, a temperature of the fixing device is falsely recognized.

When connectors are left unfitted or unconnected from each other, an oxide film may be formed on a surface of a pin of the connector. Once such an oxide film is formed on the pin of the connector, even if the connectors are fitted together to turn on power, the oxide film of the pin cannot be destroyed due to a low value of a flowing current, and an electric connection cannot be established.

When no electric connection is established in the thermistor, or noises are superimposed on a transmission path of a signal from the thermistor, a temperature may be detected higher or lower than an actual temperature.

When a high temperature is detected by mistake, the fixing device is controlled at a temperature lower than an original target temperature, and it may cause deterioration in image quality such as an occurrence of a fixing failure of a toner image on the transfer material. When a low temperature is detected by mistake, the fixing device is controlled at a temperature higher than the original target temperature, an it may cause a problem such as acceleration of deterioration of the fixing device.

To prevent contact failure of a connector caused by the oxide film, the following measures may be taken:

1. Plating the connector pin with a material which is difficult to oxidize (e.g., gold);
2. Forming the connector into a shape/structure that causes when the connectors are fitted together, the connector pins to rub each other to damage a surface of the opposite side, so that the oxide film is destroyed (e.g., Japanese Patent Application No. 8-50941); and
3. Eliminating a contact failure by supplying a current which can destroy the oxide film in a contact point after the connectors are fitted together (e.g., Japanese Patent Application Laid-Open No. 8-35860).

To make the thermistor unaffected by external noises on the signal line of the thermistor, measures may be taken, such as taking a distance from other signal lines which are noise sources or buffering a signal from the thermistor by an amplifier to transmit it.

However, since a material which is difficult to oxidize such as gold is expensive, a connector using such a material is greatly disadvantageous in cost. In the case of the connector having the structure in which the oxide film is destroyed by damaging the surface of the connector during fitting, if the connector is repeatedly attached/detached, the contact point to be conductive is damaged. Thus, the connector having such structure may not be suitable for, for example, a portion to be repeatedly attached/detached.

A circuit that supplies a current to destroy the oxide film has been put into practical use. However, the circuit has a problem in that when a temperature detection device represented by a thermistor is connected, increase in an amount of current leads to self-heating of the temperature detection device, and accuracy of temperature detection is lost.

For example, in the case of the thermistor installed within the fixing device of the image forming apparatus, when a detected temperature rises by an amount of self-heating by the thermistor, the fixing device is controlled at a temperature lower than the original target temperature, and it may cause deterioration in image quality such as an occurrence of a fixing failure of a toner image on the transfer material.

Taking a distance from the other signal lines which are noise sources to make the thermistor unaffected by external noises on the signal line of the thermistor hinders miniaturization of the apparatus.

Buffering the signal of the thermistor by the amplifier to transmit it will increase a cost of the circuit and space for an electric component.

SUMMARY OF THE INVENTION

According to an aspect of the present invention, an image forming apparatus includes an image forming unit configured to form a toner image on a sheet, a fixing unit configured to fix the toner image formed on the sheet, a temperature sensor including an element in which a resistance value increases as a temperature decreases and configured to detect a temperature of the fixing unit, a connector configured to transmit an output signal of the temperature sensor, a control unit disposed on a side opposed to the temperature sensor with respect to the connector and configured to control the temperature of the fixing unit based on the output signal of the temperature sensor, a resistor disposed on the same side as the temperature sensor with respect to the connector and connected to the temperature sensor in parallel, and a power source disposed on the side opposed to the temperature sensor with respect to the connector and configured to supply currents to the temperature sensor and the resistor via the connector.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a table illustrating a relationship between a temperature of a fixing unit and a resistance value of a thermistor.

FIG. 6 is a table illustrating a relationship among a temperature of the fixing unit, a detected voltage of the thermistor, and an analog-to-digital (A/D) converter value of a CPU.

FIG. 8 is a table illustrating a relationship among a temperature of the fixing unit, a resistance value of the thermistor, a combined resistance value, and a current value.

FIG. 9 is a table illustrating a relationship among a temperature of the fixing unit, a combined resistance value, a detected voltage of the thermistor, and an A/D converter value of the CPU.

DETAILED DESCRIPTION OF THE EMBODIMENTS

Various exemplary embodiments, features, and aspects of the invention will be described in detail below with reference to the drawings.

Figure 1:
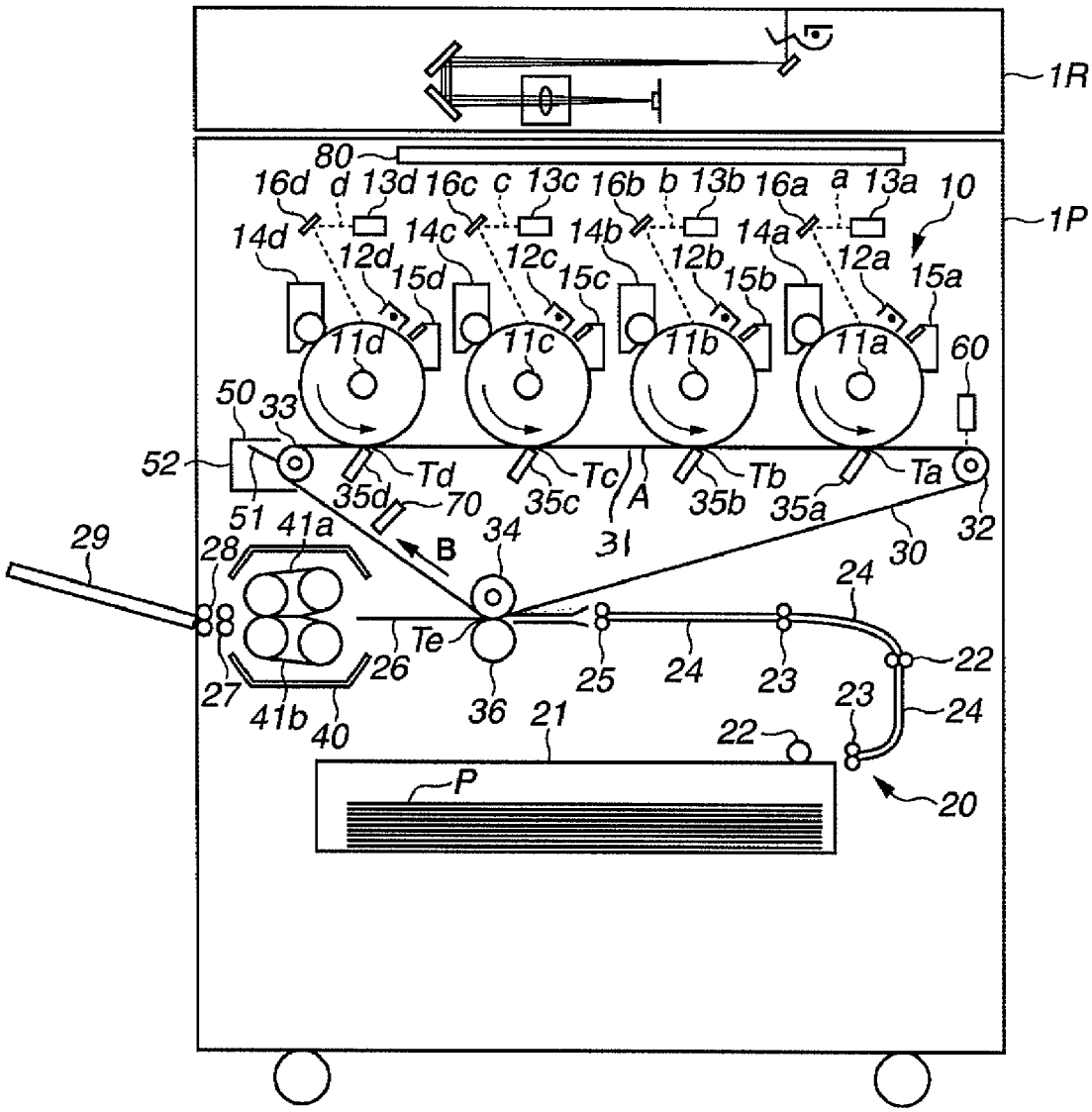
FIG. 1 illustrates a configuration of an image forming apparatus according to an exemplary embodiment of the present invention.

FIG. 1 is a sectional diagram illustrating an overall configuration of an electrophotographic color copying machine which is an image forming apparatus according to a first exemplary embodiment of the present invention. The electrophotographic color copying machine, i.e. the color image forming apparatus, includes a plurality of image forming units arrayed in parallel, and employs an intermediate transfer method.

The image forming apparatus of the present exemplary embodiment includes an image reading unit 1R and an image output unit 1P. The image reading unit 1R optically reads a document image, and converts the document image into an electric signal to transmit the converted electric signal to the image output unit 1P. The image output unit 1P includes an image forming unit 10 (10*a* to 10*d*), a paper feeding unit 20, an intermediate transfer unit 30, a fixing unit 40, cleaning units 50 and 70, a photo sensor 60, and a control unit 80.

The image forming units 10*a* to 10*d* have a similar configuration, and forms toner images of yellow, magenta, cyan, and black respectively. In FIG. 1, suffixes "a" to "d" added to reference numerals and "T" indicate individual colors yellow, magenta, cyan, and black of the image forming units. Since the image forming units are similar in configuration, one image forming unit will be described by omitting the suffixes "a" to "d".

In the image forming unit 10, a photosensitive drum 11 is rotatably supported as a first image bearing member, and rotary-driven in a direction shown by an arrow. Facing an outer peripheral surface of a photosensitive drum 11, a primary charging device 12, an optical system 13, a folding mirror 16, a development device 14, and a cleaning device 15 are arranged in a rotational direction of the photosensitive drum 11.

The primary charging device 12 applies a uniform amount of charges to a surface of the photosensitive drum 11. Then, the optical system 13 emits a ray such as a laser beam modulated according to a recording image signal from the image reading unit 1R to the photosensitive drum 11 via the folding mirror 16 to form an electrostatic latent image.

The development device 14 that stores a developer (hereinafter referred to as a toner) visualizes the electrostatic latent image. Development devices 14*a* to 14*d* respectively store toners of yellow, magenta, cyan and black.

An image visualized by each of the image forming units 10*a* to 10*d* is transferred and superimposed on a belt intermediate transfer member, i.e. an intermediate transfer belt 31 which is a second image bearing member constituting an intermediate transfer unit 30 in an image transfer area T. The intermediate transfer unit 30 will be described below.

On a downstream side of the image transfer area T, the cleaning device 15 scrapes away a toner left on the photosensitive drum 11 which was not transferred to the intermediate transfer belt 31, to clean a surface of the photosensitive drum 11. Through this process, respective toner images are sequentially formed.

The paper feeding unit 20 includes a cassette 21 for storing transfer materials P, a pickup roller 22 for delivering the transfer materials P one by one from the cassette 21, and a feeding roller pair 23 for further conveying the transfer material P delivered from the pickup roller 22. The paper feeding unit 20 further includes a feeding guide 24, and a registration roller 25 for delivering the transfer material P to a secondary transfer area Te synchronized with image forming timing of each image forming unit.

The intermediate transfer unit 30 will be described.

The intermediate transfer belt 31 is wound on a drive roller 32 for transmitting a driving force to the intermediate transfer belt 31, a driven roller 33 driven by rotation of the intermediate transfer belt 31, and a secondary transfer counter roller 34. A primary transfer plane A is formed between the drive roller 32 and the driven roller 33. The intermediate transfer belt 31 is made of, for example, polyethylene terephthalate (PET), polyfluoride vinylidene (PVdF) and the like. The drive roller 32 has a rubber (urethane or chloroprene) coat several millimeters thick on a surface of the metal roller to prevent slippage. The drive roller 32 is rotary-driven by a pulse motor (not shown).

In primary transfer areas Ta to Td where the photosensitive drums 11*a* to 11*d* and the intermediate transfer belt 31 face each other, a primary charging device 35 (35*a* to 35*d*) is disposed on the back of the intermediate transfer belt 31. A secondary transfer roller 36 is disposed to face the secondary transfer counter roller 34 to form a secondary transfer area Te by nipping the intermediate transfer belt 31. The secondary transfer roller 36 is pressed to the intermediate transfer belt 31 by appropriate pressure.

On a downstream side of the secondary transfer area Te of the intermediate transfer belt 31, a cleaning unit 50 is disposed to clean an image forming surface of the intermediate transfer belt 31. The cleaning unit 50 includes a cleaning blade 51 for removing the toner on the intermediate transfer belt 31, and a waste toner box 52 for storing the toner which has not been transferred.

The fixing unit 40 includes a fixing belt 41*a* equipped with a heating unit such as a drive circuit 220 of an induction heating (IH) coil 211 for electromagnetic-induced heating, and a pressure belt 41*b* (this belt may be equipped with a heat source) pressed on the fixing belt 41*a*. The fixing belt 41*a* and the pressure belt 41*b* can be separated from each other by a pressure release unit (not shown).

The image forming apparatus includes an internal discharge roller 27 for guiding the transfer material P discharged from the fixing unit 40 out of the apparatus, an external discharge roller 28, and a discharge tray 29 for stacking the transfer material P.

Figure 2:
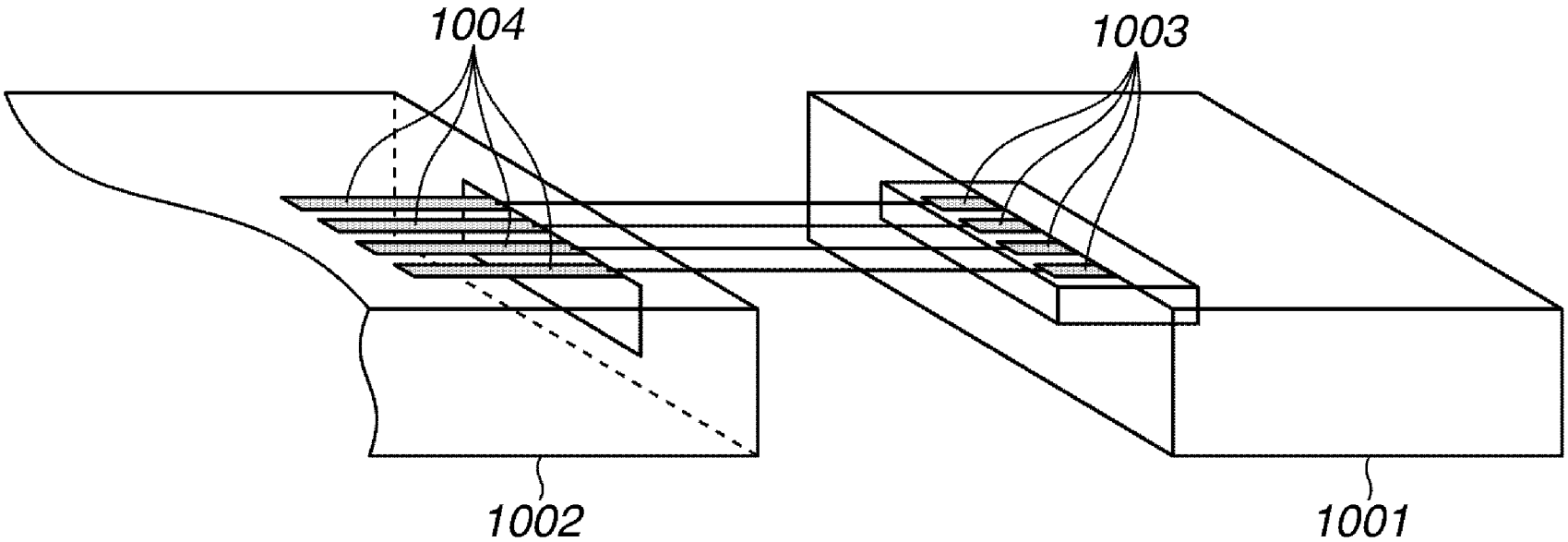
FIG. 2 illustrates a configuration of a connector unit of the image forming apparatus.

The fixing unit 40 is detachable from a main body of the image forming apparatus, and electrically connected to the main body by a detachable connector such as a drawer connector. FIG. 2 illustrates a detachable connector.

In FIG. 2, a connector 1001 is disposed on the image forming apparatus main body side, while a connector 1002 is disposed on the fixing unit 40 side. The connectors 1001 and 1002 respectively include contactors 1003 and 1004. When the connectors 1001 and 1002 are joined, the contactors 1003 and 1004 fit each other to conduct electricity.

If the connectors 1001 and 1002 are left in atmosphere unfitted or unconnected, oxide films may be formed on surfaces of connector pins of the contactors 1003 and 1004.

Once the oxide films are formed on the connector pins, even if the connectors are fitted together and electrified, the oxide films cannot be destroyed when a current value is low, and an electric connection cannot be established.

Figure 3:
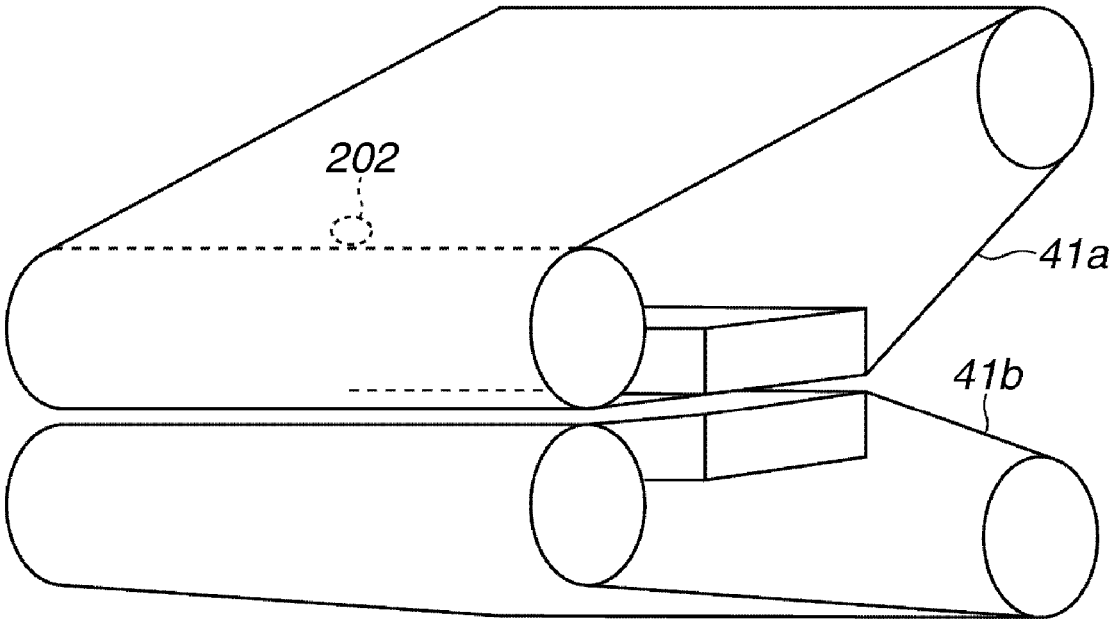
FIG. 3 illustrates a configuration in a fixing unit of the image forming apparatus.

As illustrated in FIG. 3, the fixing unit 40 includes a temperature sensor 202 for detecting a temperature of the fixing belt. A thermistor is used as an element of the temperature sensor 202.

The temperature sensor 202 detects a temperature of the belt surface and power supplied to the drive circuit 220 of the IH coil 211 is controlled so that the temperature of the belt surface reaches a preset target temperature.

Figure 4:
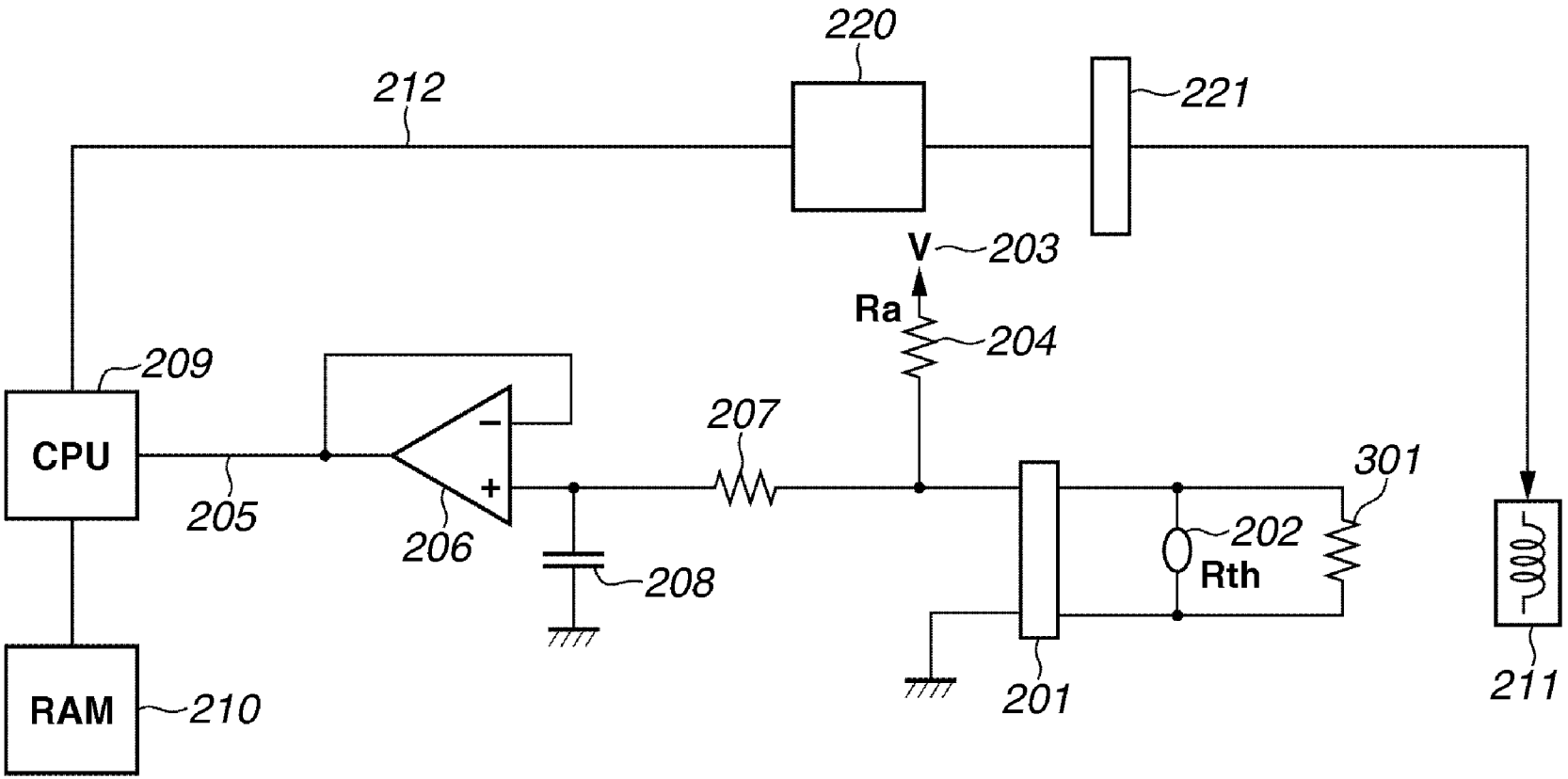
FIG. 4 illustrates a temperature control circuit according to a first exemplary embodiment.

FIG. 4 is a block diagram illustrating a circuit configuration for temperature control of the fixing unit 40.

A connector 201 indicates a fitted state of the connectors 1001 and 1002 illustrated in FIG. 2. In FIG. 4, the right side of the connector 201 is a circuit of the fixing unit 40 side, and the left side of the connector 201 is a circuit of the image forming apparatus side. The circuit includes a power source 203, a current setting resistor 204 for setting a current flowing to the thermistor 202, and a resistor 207 and a capacitor 208 which constitute a noise removal filter. The circuit includes an operational amplifier 206 for buffering an output of the thermistor 202, and a CPU 209 for controlling a temperature of the fixing device. Further, the circuit includes a coil 211 for heating the fixing device by an electromagnetic induction method, and a coil drive circuit 220 for the coil 211. The coil drive circuit 220 is connected to a commercial alternating current (AC) power source (not shown) and controls power supply to the coil 211. The CPU 209 calculates a temperature based on a detected signal 205 from the thermistor 202, and outputs a heating control signal 212 for controlling the power supply to the coil 211, to the coil drive circuit 220 so that the detected temperature can be a predetermined temperature. The connector 221 connects the coil 211 with the AC power source. A large current of about 8 amperes flows in the connector 221. Thus, even if an oxide film is formed on the connector 221, the oxide film is destroyed by a current for driving the coil 211. A resistor 301 is disposed to set a current flowing to the connector 201 to a predetermined value or more. The resistor 301 will be described below in detail.

A temperature detection method by the thermistor will be described below.

Power is supplied to the thermistor 202 via the connector unit 201 from the power source 203 which is disposed on a side opposed to the thermistor 202 across the connector unit 201. A value of a current flowing to the thermistor 202 is determined based on a voltage value V of the power source 203 and a resistance value Ra of the current setting resistor 204. The thermistor 202 is a device having characteristics in which a resistance value Rth changes depending on a temperature T.

FIG. 5 illustrates characteristics of the thermistor 202. A detected voltage (Vdet) of the thermistor 202 is determined by the following expression:

$$Vdet=(V/(Ra+Rth))\times Rth$$

For example, in the case where V=3.3 V, Ra=2 kΩ, and T=220° C., according to characteristics of FIG. 5, Vdet=0.517V is obtained because Rth=0.368 kΩ. The detected voltage Vdet is buffered by the operation amplifier 206 via the resistor 207 and the capacitor 208 constituting the noise removal filter, and entered to an A/D converter of the CPU 209.

The above expression determines a temperature T with respect to the detected voltage Vdet. A RAM 210 for backup stores a table of FIG. 6 illustrating correspondence between a temperature and a detected voltage. When resolution of the A/D converter of the CPU 209 is 8 bits, the CPU 209 can read the detected voltage Vdet by a digital value (AD value) shown in FIG. 6. The CPU 209 can obtain a corresponding temperature T from the read detected voltage.

Next, an operation of the electrophotographic color copying machine including the above configuration will be described.

When the CPU 209 issues a start signal of an image forming operation, the pickup roller 22 delivers the transfer material P one by one from the cassette 21. The feeding roller pair 23 guides the transfer material P between the feeding guides 24 to convey it to the registration roller 25. At this time, the registration roller 25 is not driven, and the leading edge of the transfer material P abuts on a nipping part of the registration roller 25. Then, the registration roller 25 starts rotating in synchronization with image formation start by the image forming unit. Timing of the rotation period is set so that the transfer material P and a toner image primary-transferred on the intermediate transfer belt 31 by the image forming unit can match each other in the secondary transfer area Te.

In the image forming unit, when the image forming start signal is issued, a toner image formed on the photosensitive drum 11*d* is primary-transferred to the intermediate transfer belt 31 in the primary transfer area Td by the primary transfer charging device 35*d* to which a high voltage has been applied according to the above described process. The primary-transferred toner image is conveyed to the next primary transfer area Tc. There, image formation is delayed for a time equal to conveying of a toner image between the image forming units, and a next toner image is transferred and superimposed on the toner image which has been transferred. The same process is repeated thereafter, and toner images of four colors are transferred on the intermediate transfer belt 31.

Subsequently, when the transfer material P enters the secondary transfer area Te and reaches the intermediate transfer belt 31, a high voltage is applied to the secondary transfer roller 36 when the transfer material P is transferred. Thus, the toner images of four colors formed on the intermediate transfer belt 31 through the above processes are transferred to the surface of the transfer material P. Then, a conveyance guide 26 conveys the transfer material P to the fixing unit 40. The toner images are fixed on the surface of the transfer material P by heat of the belts 41*a* and 41*b* and nipping pressure. The transfer material P is conveyed by the internal discharge roller 27 and the external discharge roller 28, discharged out of the apparatus, and stacked on the discharge tray 29.

Next, referring to FIGS. 4 and 7, a configuration for stabilizing a conductive state of the signal line and the connector unit for connecting the fixing unit 40 to the image forming apparatus main body will be described.

In FIG. 4, the resistor 301 is disposed on the same side of the thermistor 202 with respect to the connector unit 201, and connected to the thermistor 202 in parallel. FIG. 7 illustrates that current paths for supplying currents to the thermistor 202 and the resistor 301 are added to FIG. 4. Since the thermistor 202 has a high resistance value especially in a low-temperature environment, a value of a current flowing to a signal line (a path A illustrated in FIG. 7) from the connector unit 201 to the thermistor 202 is very small. Thus, in the low-temperature environment, a detected signal from the thermistor 202 is easily affected by external noises, and when an oxide film is formed on a terminal of the connector unit 201, the oxide film cannot be destroyed. If a current flowing to the signal line including the connector unit 201 is merely increased, self-heating of the thermistor becomes large, and a detected result may deviate from a fixing temperature.

Figure 7:
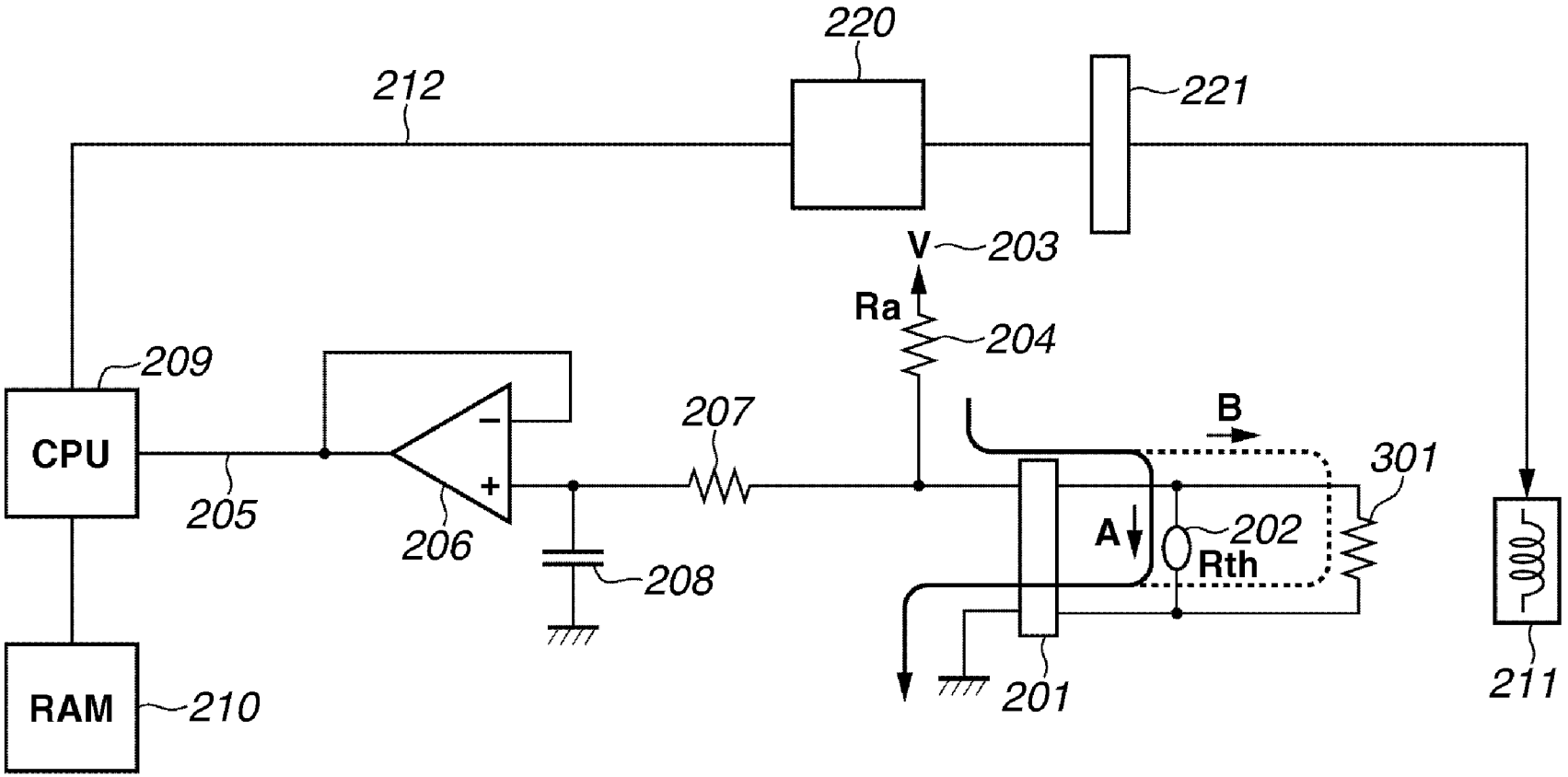
FIG. 7 illustrates a current path in the circuit of FIG. 4.
Figure 12:
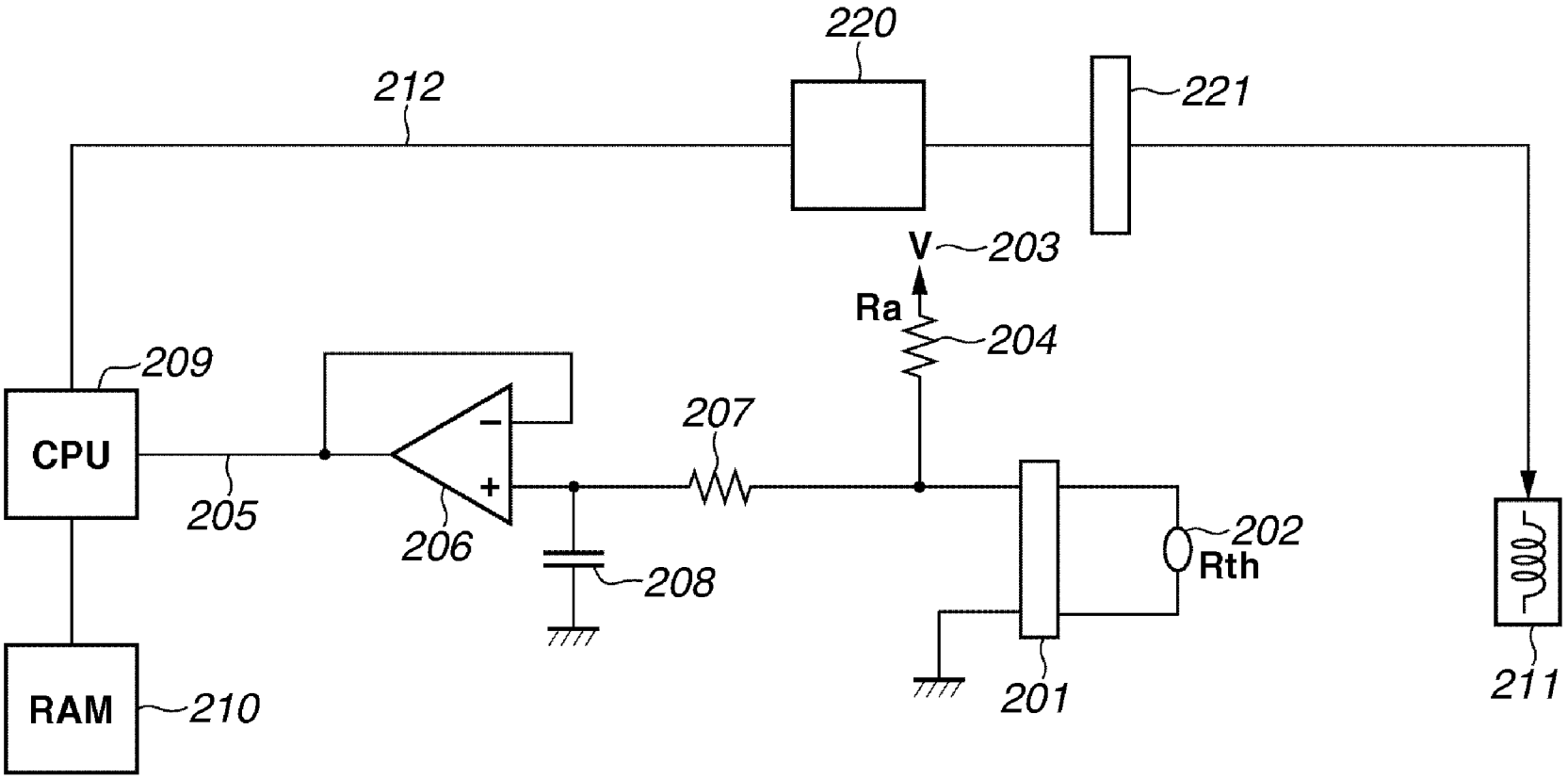
FIG.12 PRIOR ART
FIG. 12 illustrates a conventional temperature detection circuit.

Thus, by adding the resistor 301 to the conventional circuit illustrated in FIG. 12, a current value of the current path B of FIG. 7 is increased. More specifically, the resistor 301 is disposed so that a certain amount of current or more can flow through the connector unit 201 and the signal line irrespective of a resistance value of the thermistor 202. In other words, by disposing the resistor 301 on the thermistor 202 side with respect to the connector unit 201, a current flowing to the connector unit 201 can be increased. As a result, resistance to external noise of a detected signal from the thermistor 202 can be improved. Further, when an oxide film is formed on the connector unit 201, a current which can melt and destroy the oxide film is supplied.

When the resistor 301 is disposed on a side opposed to the thermistor 202 (the control unit side of the CPU 209) across the connector unit 201, the current path B of FIG. 7 cannot be formed. Thus, a current flowing to the connector unit 201 cannot be increased.

A current flowing through the signal line to the connector unit 201 and thermistor 202 needs to have a value sufficient to make the detected signal from the thermistor 202 unaffected by external noises of the signal line, and to melt and destroy the oxide film formed on the terminal of the connector unit 201. A resistance value of the resistor 301 is set so that a current flowing to the resistor 301 can be larger than that flowing to the thermistor 202.

In the present exemplary embodiment, the current value is set to 1.0 mA or more. To set the current value flowing through the signal line to the connector unit 201 and the thermistor 202 to 1.0 mA or more, the resistance value of the resistor 301 is set to 2.4 kΩ, and a resistance value of the current setting resistor 204 is set to 2.4 kΩ. A voltage value of the power source 203 is set to 5 V. By setting values as described above, a relationship among a current value flowing to the connector unit 201 and the signal line, a resistance value of the thermistor 202, a combined resistance value of the thermistor 202 and the resistor 301, and a detected temperature is as shown in FIG. 8.

For example, when a detected temperature of the thermistor is 20° C., since a resistance value of the thermistor 202 is 43.907 kΩ, a combined resistance value is as follows:

$$1/\{(1/43.907\ \text{k}\Omega)+(1/2.4\Omega)\}=2.276\ \text{k}\Omega$$

In this case, a current value is as follows:

$$5\text{V}/(2.276\ \text{k}\Omega+2.4\ \text{k}\Omega)=1.069\ \text{mA}$$

FIG. 9 illustrates a relationship among a combined resistance value of the thermistor 202 and the resistor 301, a detected voltage of the thermistor 202 (a voltage of detected signal 205), and a digital value of the A/D converter of the CPU 209 in the circuit illustrated in FIGS. 4 and 7.

A detected voltage (Vdet) is determined as follows:

$$Vdet=(V/(Ra+\text{combined resistance value}))\times\text{combined resistance value}$$

For example, in the case of a detected temperature of 20° C., a combined resistance value is 2.276 kΩ as above described. Further, a voltage value V of the power source 203 is 5 V and a resistance value Ra of the current setting resistor 204 is 2.4 kΩ, so that Vdet=(5/(2.4+2.276))×2.276=2.433 V is set.

A relationship between the detected voltage Vdet and an AD input value is represented by a value of FIG. 9 when resolution of the A/D converter of the CPU 209 is 8 bits. Thus, a temperature of the fixing unit 40 can be calculated from the read detected voltage when the table of FIG. 9 is stored in the RAM 210.

Figure 10A:
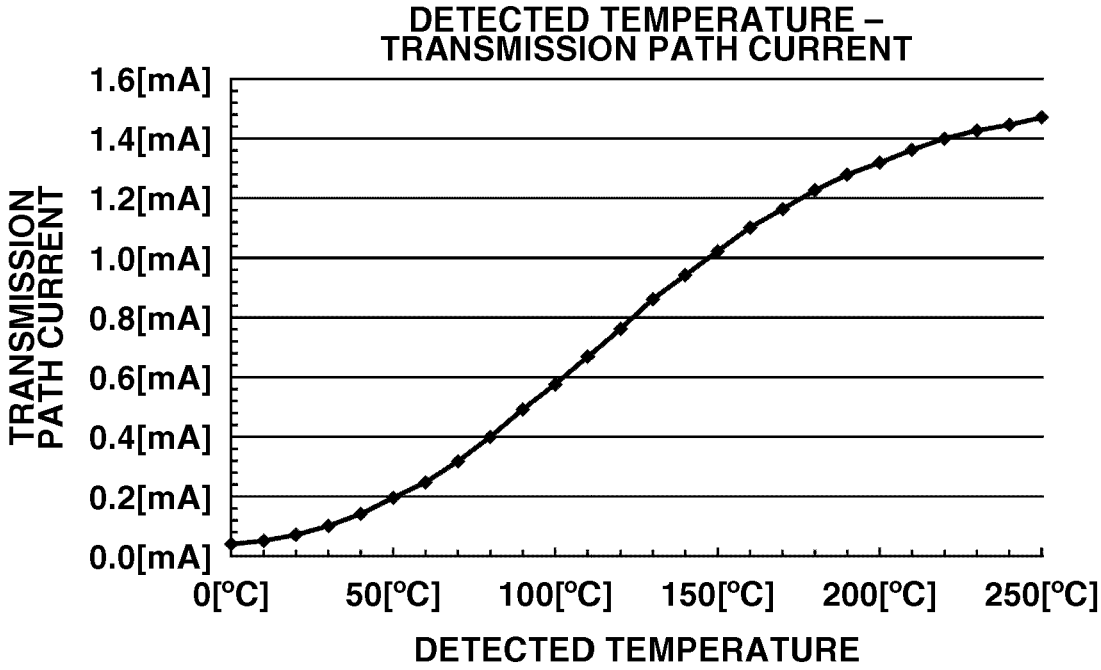
FIGS. 10A and 10B illustrate relationships between temperatures of fixing units and currents flowing through signal lines of thermistors according to a conventional example and the first exemplary embodiment.
Figure 10B:
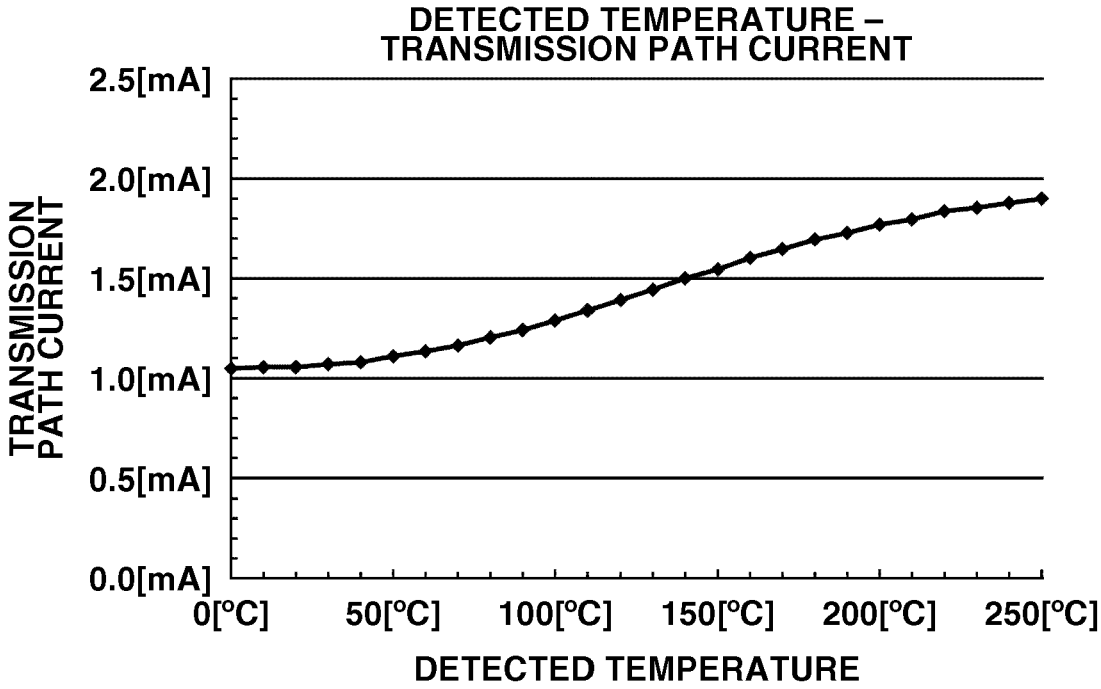

FIG. 10A is a graph illustrating a relationship between a detected temperature and a current of a signal line in a conventional configuration illustrated in FIG. 12 in which no resistor 301 is disposed. FIG. 10B is a graph illustrating a relationship between a detected temperature and a current of the signal line in the present exemplary embodiment. As illustrated in FIG. 1A, in the conventional configuration, when a detected temperature is 20° C., a value of a current flowing to the connector unit 201 and the signal line is about 0.1 mA (100 μA). On the other hand, in the configuration of the present exemplary embodiment, a current flowing via the resistor 301 is added to the current value by providing the resistor 301. Thus, even in an environment of 20° C., the current value of 1.0 mA or more can be secured.

Figure 11:
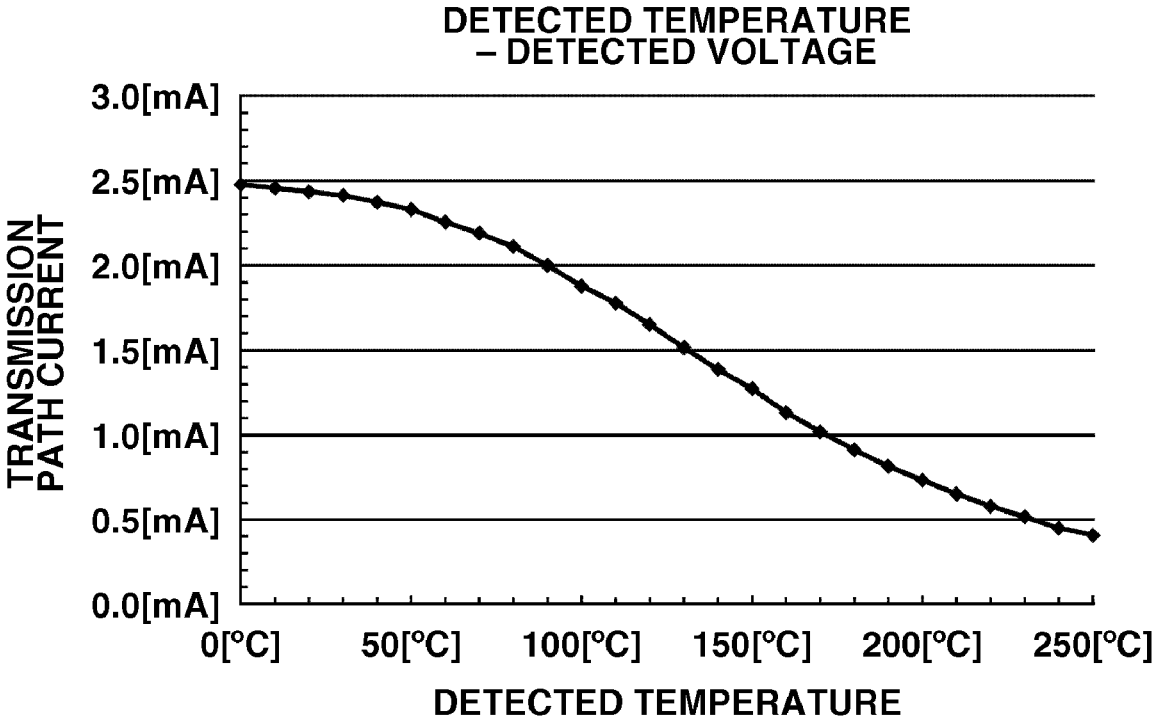
FIG. 11 illustrates a relationship between a temperature of the fixing unit and a detected voltage of the thermistor.

FIG. 11 is a graph illustrating a relationship between a detected voltage and a detected temperature.

Values of the power source 203 and the current setting resistor 204 can be set in view of the resolution of the A/D converter of the CPU 209. A target value of a current flowing to the connector unit 201 is desirable to be set such that self-heating of the thermistor due to supplying a current to the thermistor 202 falls within a permissible range. Therefore, in the present exemplary embodiment, temperature increase of the thermistor 202 is set to 1° C. or less (near a control temperature of 220° C.). Further, in the present exemplary embodiment, a voltage value of the power source 203 is set to 5V, and resistance values of the current setting resistor 204 and the resistor 301 are set to 2.4 kΩ. However, settings of these values are not limited to the above values. Values can be appropriately set according to the apparatus.

More specifically, a value of the resistor 301, and when necessary, a voltage value of the power source 203 and a value of the current setting resistor 204 may be determined by taking the following points into consideration.

1. A current value which is not affected by external noises on the signal line of the thermistor 202, and sufficient to melt and destroy an oxide film when the oxide film is formed on the terminal of the connector unit 201,
2. Resolution of a detected voltage, and
3. A self-heating of the thermistor As described above, when the fixing unit 40 is in a low-temperature state and only a small amount of a current flows in the thermistor, a current value in the connector unit and the signal line on the signal line of the thermistor can be increased while suppressing the self-heating of the thermistor. Thus, a temperature can be detected with high accuracy by improving resistance to external noises on the signal line of the thermistor and a conductive state of the connector unit.

A value of the resistor 301 is not limited to the above value. A value may be set according to specifications of the terminal of the connector unit 201 or a status of the signal line of the thermistor.

Figure 13:
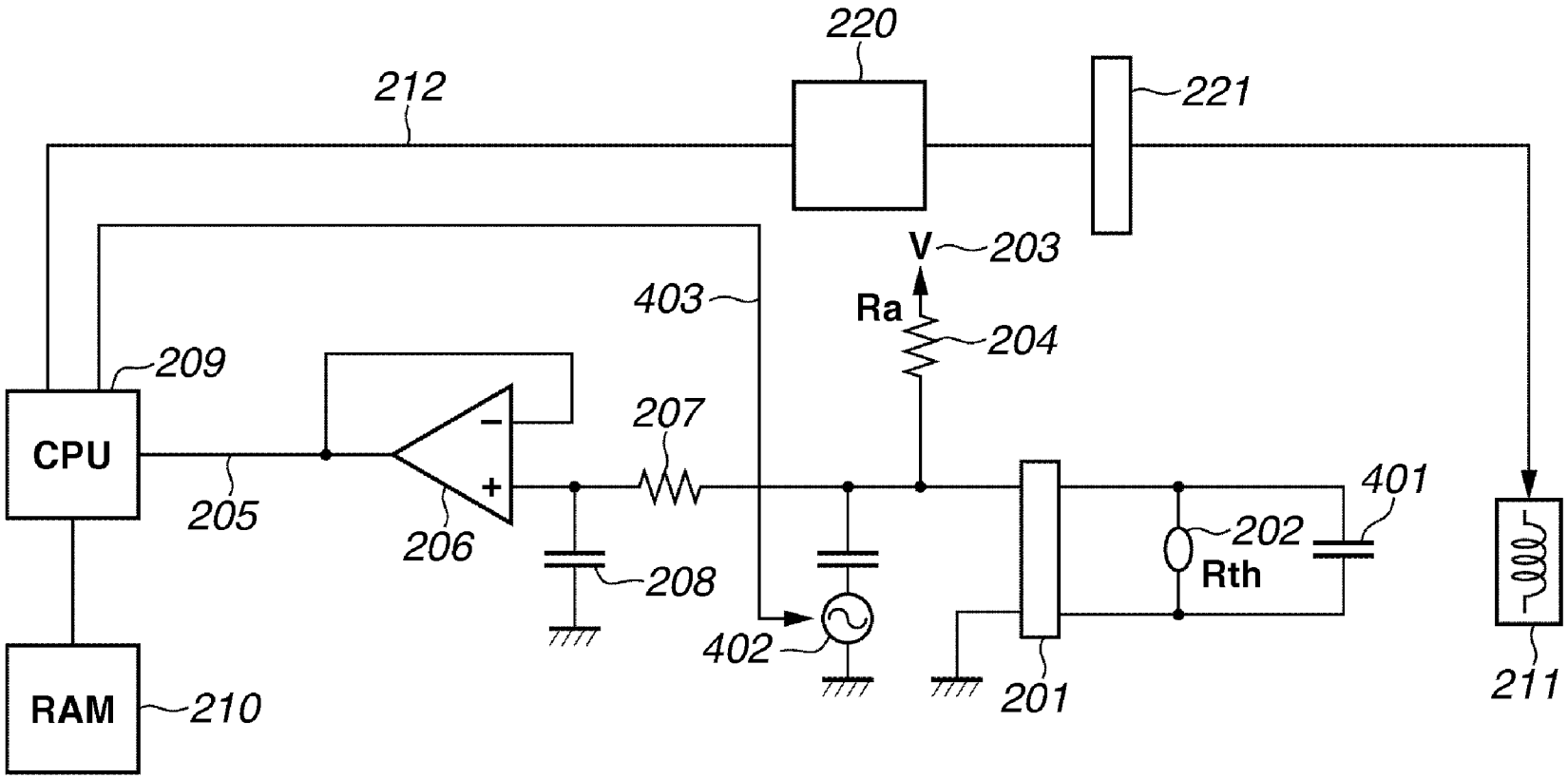
FIG. 13 illustrates a temperature control circuit according to a second exemplary embodiment.

FIG. 13 illustrates a temperature control circuit according to a second exemplary embodiment. Components similar to those of FIG. 4 are denoted by the same reference numerals, and detailed description thereof is omitted.

Figure 15:
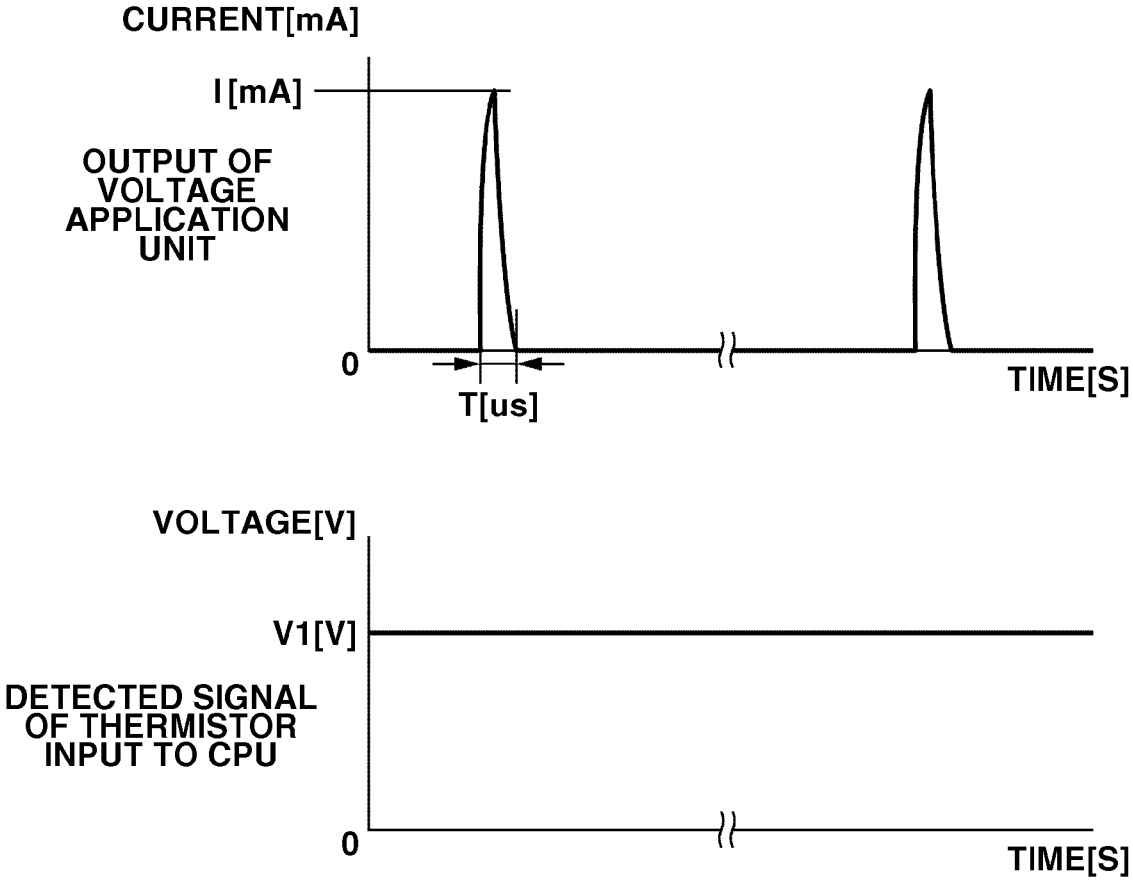
FIG. 15 illustrates a current flowing caused by a voltage of a voltage application unit.

The temperature control circuit of FIG. 13 is different from the circuit of FIG. 4 in that a capacitor 401 is disposed in place of the resistor 301, and a voltage application unit 402 and a control signal line 403 wired from the CPU 209 to the voltage application unit 402 are disposed. An applied signal for instantly generating a voltage of a pulse waveform is supplied to the control signal line 403 from the voltage application unit 402. The voltage application unit 402 superimposes a pulse current as illustrated in FIG. 15 on a current path from the connector 201 to the capacitor 401 based on an applied signal from the CPU 209. The applied signal is output from the CPU 209 at the timing of turn-on the power of the image forming apparatus, an input of an instruction for starting image formation, and connection of the connector 201. However, the CPU 209 may generate an applied signal by optional timing.

The capacitor 401 is disposed on the same side of the thermistor 202 with respect to the connector unit 201, and the voltage application unit 402 is disposed on a side opposed to the thermistor 202 across the connector unit 201. A pulse voltage is generated from the voltage application unit 402, and superimposed on a current flowing to the connector unit 201, so that a current flowing to the connector unit 201 can be increased.

Figure 14:
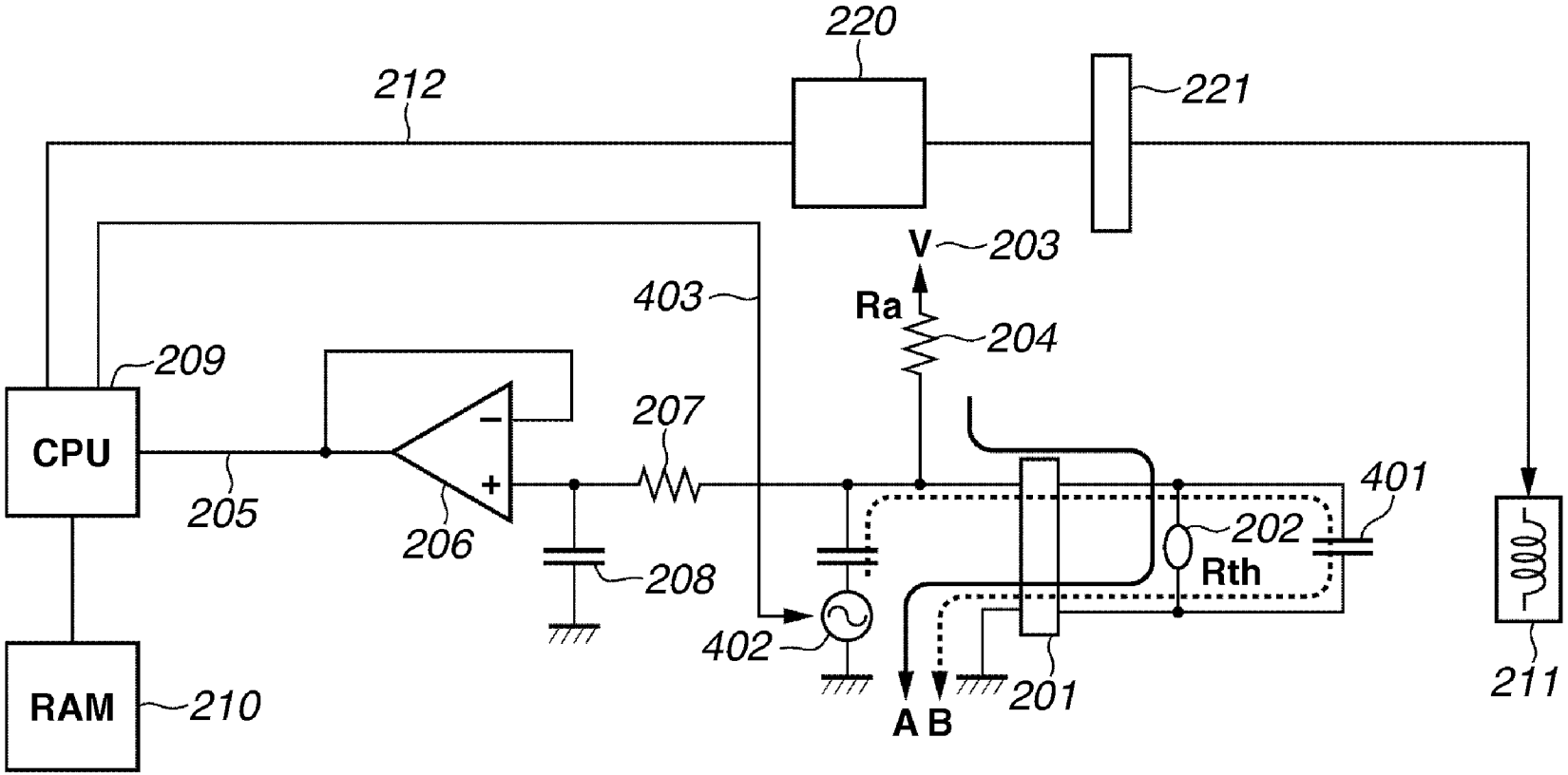
FIG. 14 illustrates a current path in the circuit of FIG. 13.

FIG. 14 illustrates current paths in the circuit of FIG. 13. Since the thermistor 202 has a high resistance value in a low-temperature environment, a value of a current flowing to the connector unit 201 and flowing to the thermistor 202 via the connector unit 201 on a signal line (a path A of FIG. 14) is very small. In such a case, as described above, when an oxide film is formed on the terminal of the connector unit 201, even if a current flows in the connector unit 201, the oxide film may not be destroyed, and contact failure may occur.

Thus, by adding the capacitor 401 and the voltage application unit 402, a value of a current flowing to the connector unit 201 on the current path B of FIG. 14 is increased.

FIG. 15 is a waveform chart illustrating a pulse current output from the voltage application unit 402 and a detected signal 205 of the thermistor 202 when the pulse current is applied. The pulse current may be set to a current value and application time sufficient to melt and destroy an oxide film when the oxide film is generated on the terminal of the connector unit 201. A capacity of the capacitor 401 is set so that a peak value of a current flowing to the capacitor 401 can be larger than a direct current flowing to the thermistor 202. In the present exemplary embodiment, a current value I and application time T of the pulse current are respectively set to 100 mA and 0.1 μs. The current value and the application time are not limited to these values, and may be appropriately set according to specifications of the terminal of the connector unit 201.

The capacity of the capacitor 401 may be set to a value which allows passage of the pulse current superimposed by the voltage application unit 402 and satisfies responsiveness required in temperature detection. For example, in the present exemplary embodiment, the capacity of the capacitor 401 is set to 22 μF. However, the capacity of the capacitor 401 is not limited to this value.

Thus, as illustrated in FIG. 15, the CPU 209 can detect the detected signal of the thermistor 202 as a direct current irrespective of whether the pulse current from the voltage application unit 402 is superimposed or not. Thus, the CPU 209 can accurately control the fixing unit 40 to a target temperature.

Figure 16:
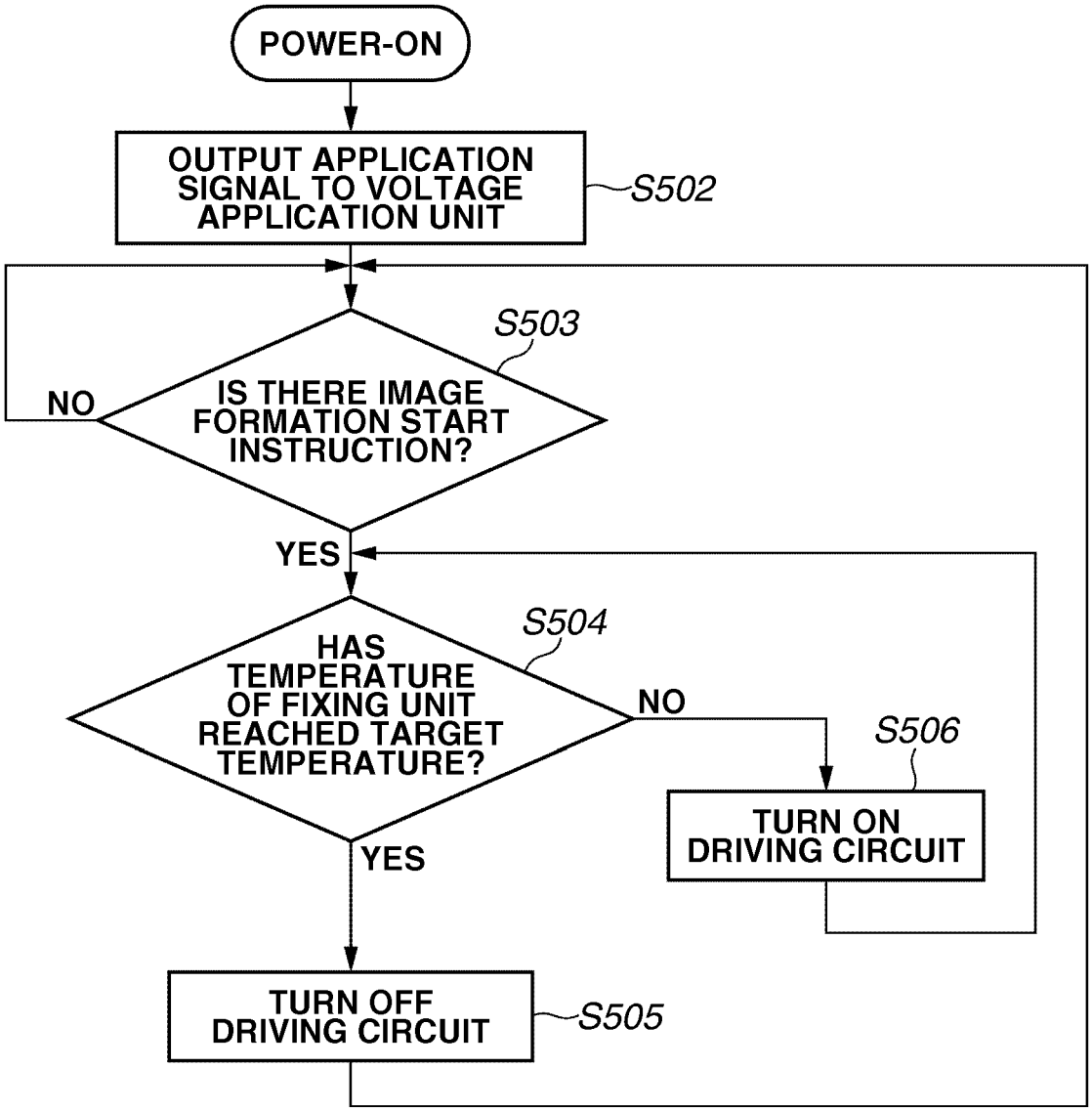
FIG. 16 is a control flowchart of a CPU according to the second exemplary embodiment.

Next, referring to FIG. 16, a control sequence of the CPU 209 according to the present exemplary embodiment will be described. FIG. 16 is a flowchart illustrating temperature control of the fixing unit executed by the CPU 209.

When power is turned on in the image forming apparatus, in step S502, the CPU 209 outputs an applied signal 403 to the voltage application unit 402. The voltage application unit 402 superimposes a pulse current on the current path of the thermistor 202 based on the applied signal 403. In this case, a current flowing to the connector unit 201 increases. Thus, even if an oxide film has been formed on the connector unit 201, the current destroys the oxide film to improve a conductive state of a signal flowing from the thermistor 202. As described above, timing of outputting the applied signal 403 to the voltage application unit 402 by the CPU 209 is not limited to the timing when the power is turned on.

Subsequently, in step S503, the CPU 209 determines whether an instruction for staring image formation has been input. If no image formation starting instruction has been input (NO in step S503), the CPU 209 waits for an instruction while maintaining the drive circuit 220 of the fixing unit 40 at a turn-off state. If the image formation starting instruction has been input (YES in step S503), then in step S504, the CPU 209 determines whether a temperature of the fixing unit 40 has reached a target temperature. If the temperature of the fixing unit 40 has reached the target temperature (YES in step S504), then in step S505, the CPU 209 maintains the turn-off state of the drive circuit 220 of the fixing unit and returns again to step S503. If the temperature of the fixing unit 40 has not reached the target temperature (NO in step S504), then in step S506, the CPU 209 drives the drive circuit 211 of the fixing unit 40, heats the fixing unit 40 by electromagnetic induction heating, and returns again to the step S504. In the present exemplary embodiment, because the electromagnetic induction heating method is used in the fixing unit, heating of the fixing unit 40 is started after the input of the image formation starting instruction. However, in the case of a fixing unit which uses a halogen heater, heating is started after power is turned on.

As described above, when a temperature of the fixing unit 40 is low, and only a small amount of current flows in the thermistor 202, a current value in the connector unit 201 and the signal line can be increased while suppressing the self-heating of the thermistor 202. As a result, temperature detection and temperature control can be performed with high accuracy by improving a conductive state of the connector unit 201.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-150487 filed Jun. 9, 2008, which is hereby incorporated by reference herein in its entirety.

What is claimed is:

1. An image forming apparatus comprising:

an image forming unit configured to form a toner image on a sheet;

a fixing unit configured to fix the toner image formed on the sheet;

a temperature sensor including an element in which a resistance value increases as a temperature decreases and configured to detect a temperature of the fixing unit;

a connector configured to transmit an output signal of the temperature sensor;

a control unit disposed on a side opposed to the temperature sensor with respect to the connector and configured to control the temperature of the fixing unit based on the output signal of the temperature sensor;

a capacitor disposed on the same side as the temperature sensor with respect to the connector and connected to the temperature sensor in parallel;

a power source disposed on the side opposed to the temperature sensor with respect to the connector and configured to supply a current to the temperature sensor via the connector so that the temperature sensor operates; and a voltage application unit disposed on the same side as the control unit with respect to the connector and configured to supply a pulse current, to be superimposed on the current supplied by the power source, to the capacitor via the connector so as to temporarily increase the current flowing to the connector to a value sufficient to reduce an oxide film formed on the connector, wherein a capacity of the capacitor is set so that a peak value of the pulse current flowing to the capacitor by the voltage application unit is larger than a direct current flowing from the power source to the temperature sensor, and wherein the control unit outputs a signal to the voltage application unit so that the voltage application unit supplies the pulse current to the capacitor via the connector at a timing before the control unit starts to control the temperature of the fixing unit.

2. The image forming apparatus according to claim 1, wherein the temperature sensor is a thermistor.

3. The image forming apparatus according to claim 1, wherein the control unit outputs the signal in response to turn-on of power for the image forming apparatus.

* * * * *